US005297602A

United States Patent [19]

Nobbe

[11] Patent Number: 5,297,602

[45] Date of Patent: * Mar. 29, 1994

[54] WOODEN POLE BENDER

[76] Inventor: Paul J. Nobbe, 11177 U.S. Highway 52, Brookville, Ind. 47012

[ * ] Notice: The portion of the term of this patent subsequent to Feb. 2, 2010 has been disclaimed.

[21] Appl. No.: 9,809

[22] Filed: Jan. 27, 1993

Related U.S. Application Data

[63] Continuation-in-part of Ser. No. 877,643, May 1, 1992, Pat. No. 5,183,091.

[51] Int. Cl.[5] ..... B27H 1/00

[52] U.S. Cl. ..... 144/360; 144/270; 144/381; 269/234; 269/296

[58] Field of Search ..... 269/236, 296; 144/2.2, 144/3, 254, 255, 270, 271, 343, 359, 361, 362, 365, 364, 360, 380

[56] References Cited

U.S. PATENT DOCUMENTS

| | | | |
|---|---|---|---|
| 360,848 | 4/1887 | Bond | 144/381 |
| 361,123 | 4/1887 | Bond | 144/270 |
| 1,994,607 | 3/1935 | Derby | 144/254 |
| 2,081,638 | 5/1937 | Owens | 144/254 |
| 3,003,204 | 10/1961 | Bryant | 144/381 |
| 4,469,156 | 9/1984 | Norimoto et al. | 144/254 |
| 4,741,371 | 5/1988 | Lord | 144/270 |
| 5,183,091 | 2/1993 | Nobbe | 144/360 |

*Primary Examiner*—W. Donald Bray
*Attorney, Agent, or Firm*—Woodard, Emhardt, Naughton, Moriarty & McNett

[57] ABSTRACT

A method and fixture for placing a permanent bend into a wooden pole. In the preferred embodiment, a fixture includes a center block receiving the center portion of a pole having the opposite ends of the pole extending through the opposite ends of the fixture. A pair of cylindrical tubes are forced downwardly against the opposite ends of the pole by an external cylinder motor and, in turn, forces the opposite ends of the pole against the bottom wall of the fixture, thereby bending the pole. A pair of wedge shaped members are extended through the fixture and into the cylindrical tubes, thereby holding the cylindrical tubes downwardly against the pole in a bent configuration while the external force is removed. The method of permanently bending a green pole includes harvesting a tree during the warm growing season and then removing the limbs to produce a wooden pole. The pole is then heated to kill living things within the pole and stored for future use and/or bending.

15 Claims, 3 Drawing Sheets

WOODEN POLE BENDER

CROSS REFERENCE TO RELATED APPLICATION

This application is a continuation-in-part in my copending allowed U.S. patent application, Ser. No. 07/877,643, filed May 1, 1992, now U.S. Pat. No. 5,183,091 and entitled WOODEN POLE BENDER.

BACKGROUND OF THE INVENTION

1. Field of the Invention

This invention is in the field of fixtures and more specifically, those fixtures utilized to bend pieces of wood.

2. Description of the Prior Art

Various types of articles utilize bent pieces of wood. For example, furniture including chairs may be designed to include a curved or bent wooden pole extending along the back of the furniture or chair. Since it is difficult to obtain a sufficient quantity of uniformly configured wooden trees in the natural state, it is the custom to harvest trees and to then bend the trees into the desired configuration forming the poles.

In the event the harvested wooden tree has an insect such as a beetle living therein, then eventually the bark may loosen relative to the main body of the tree since the beetle will bore into the tree. Of particular nuisance is the powder post beetle which attacks and lives within hickory trees. Beetle eggs typically will not hatch except during the warm or growing season. As a result, it has been the custom to harvest the trees during the winter when the trees are in a dormant state. Trees harvested during the dormant state are dry and brittle requiring the trees to first be subjected to heat thereby destroying any beetle eggs, and then soaked in water thereby increasing the flexibility of the trees and allowing the trees to be bent to the desired configuration. Next it is the practice to heat the trees in the bent configuration while wet setting the final configuration. Harvesting of the trees during the warm growing season has been avoided due to the fear that hatched beetles would attack the trees after the trees are harvested and dead but before heating and bending of the trees to the desired configuration. As a result, the business of harvesting and bending trees has been cyclical occurring during the winter and not during the warm growing season. I have discovered that trees can be harvested during the growing season while in the green state and bent to the desired configuration so long as the trees are bent soon after harvesting while the trees are still green and thus before the eggs are hatched. Since the trees are still green by the time of bending, the initial step of heating and wetting may be avoided with the final heating step accomplishing both the setting of the desired configuration as well as destroying any eggs or insects within the trees.

The prior method of bending dry poles harvested in the dormant state includes use of a fixture for holding a plurality of dry poles arranged in parallel fashion. The fixture includes a single rod which extends perpendicularly across the dry poles with the opposite ends of the rod fastened to the fixture thereby bending the poles. In the event, the dry poles have different diameters then the rod will bend the poles to different curvatures thereby preventing uniformity. The fixture disclosed herein eliminates this disadvantage.

The prior art includes a variety of tools for bending wood to different desired configurations. For example, U.S. Pat. No. 360,848 and 361,123 disclose heating and bending wood for use in production of a violin case, whereas U.S. Pat. No. 4,741,371 discloses a jig for bending a hockey stick blade to the desired configuration. U.S. Pat. No. 2,081,638 discloses a technique of forming a rounded corner in a sheet of wood, whereas U.S. Pat. No. 3,003,204 discloses technique particularly useful with corrugated wood laminate. U.S. Pat. No. 1,994,607 discloses a process of shaping green wood by removing moisture therefrom through the application of electrical potential across the opposite sides of the wood. U.S. Pat. No. 4,469,156 discloses a method and apparatus for shaping wood materials, wherein the wood is first saturated with water and then microwave irradiation is used for the heating stage.

In my parent patent application I disclose a holding fixture, wherein the opposite ends of the pole are held relatively fixed in the fixture, whereas an external force is applied to the center portion of the wood forcing the pole to the desired bent configuration. Disclosed herein is a further variation which achieves the same result but by the reverse process of holding the center portion of the pole in a relatively fixed position, whereas an external force is applied to the opposite ends of the pole, bending the pole to the desired configuration while held in the fixture.

I have further discovered that my invention is particularly useful in allowing trees to be harvested during the warm growing season so long as the harvested wood is heated in a kiln subsequent to the harvesting step but during the warm growing season to destroy the living things, such as the powder post beetle located within the pole. Previously, trees have been harvested during the winter for fear that the eggs within a tree harvested during the summer will hatch, thereby loosening the bark from the pole. I have discovered that the trees may be harvested during the summer if they are fairly soon after harvesting heated in the kiln to kill all beetle eggs and all other living things within the pole. The poles may then be stored to be subsequently used in either a bent or unbent configuration. In the event the poles are to be utilized in a bent configuration then the harvested summer poles may be inserted in the fixture disclosed herein at anytime during the year, including the winter season and bent to the final configuration.

SUMMARY OF THE INVENTION

One embodiment of the present invention is a method to permanently bend a green wooden pole to a final configuration by positioning a green wooden pole in a holding fixture, locating the opposite ends of the pole at predetermined elevations, forcing the center of the pole to an elevation past the elevations to bend the pole to the desired bent configuration, heating the pole while bent to kill living things foreign to but located in the pole while permanently setting the bent configuration in the pole, and, finally removing the pole from the holding fixture.

A further embodiment of the present invention is a fixture for placing a permanent bend into a wooden pole creating a bent configuration comprising a frame device with opposite portions to receive the opposite ends of the wooden pole with the frame device also including a middle portion located between the opposite portions against which the center portion of the wooden pole may be located. An intermediate member is positionable against the center portion of the pole and a force generating device with an output restable against the intermediate member is operable to force the intermediate member against the pole and the pole against the middle portion of the frame device creating a bend in the pole. A holding device is engaged with the frame device and the intermediate member and is operable to hold the intermediate member against the pole in the bent configuration even though the force generating device is removed.

It is an object of the present invention to provide a new and improved fixture for bending a wooden pole.

A further object of the present invention is to provide a method of permanently bending a green wooden pole to a final configuration.

In addition, it is an object of the present invention to provide a method and tool for bending poles harvested throughout the year.

In addition, it is an object of the present invention to provide a method and device for allowing trees to be harvested during the warm growing season for subsequent bending and use throughout the year including the winter season.

Related objects and advantages of the present invention will be apparent from the following description.

DESCRIPTION OF THE PREFERRED EMBODIMENTS

Figure 1:
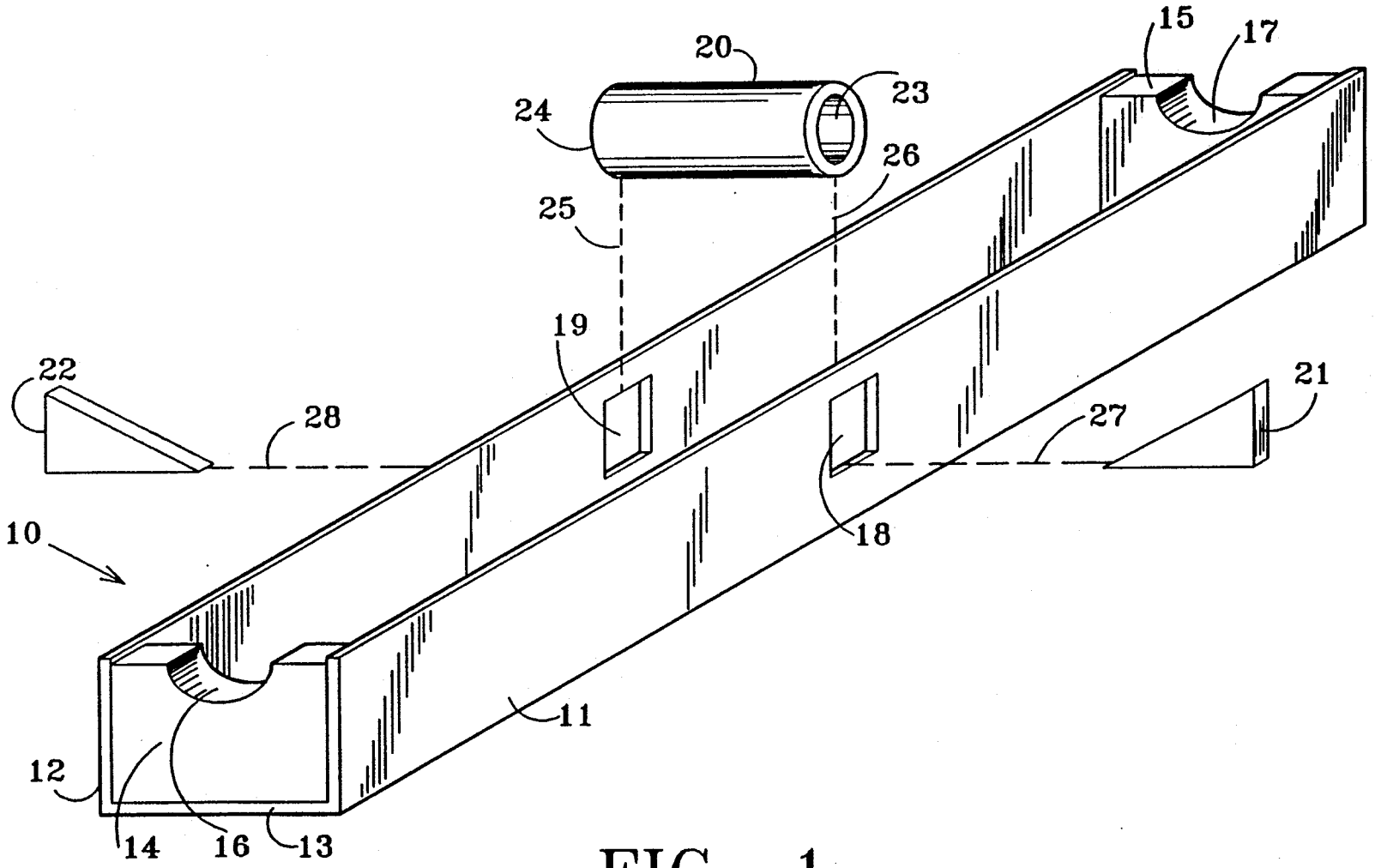
FIG. 1 is an exploded perspective view of the holding fixture of an alternate embodiment incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
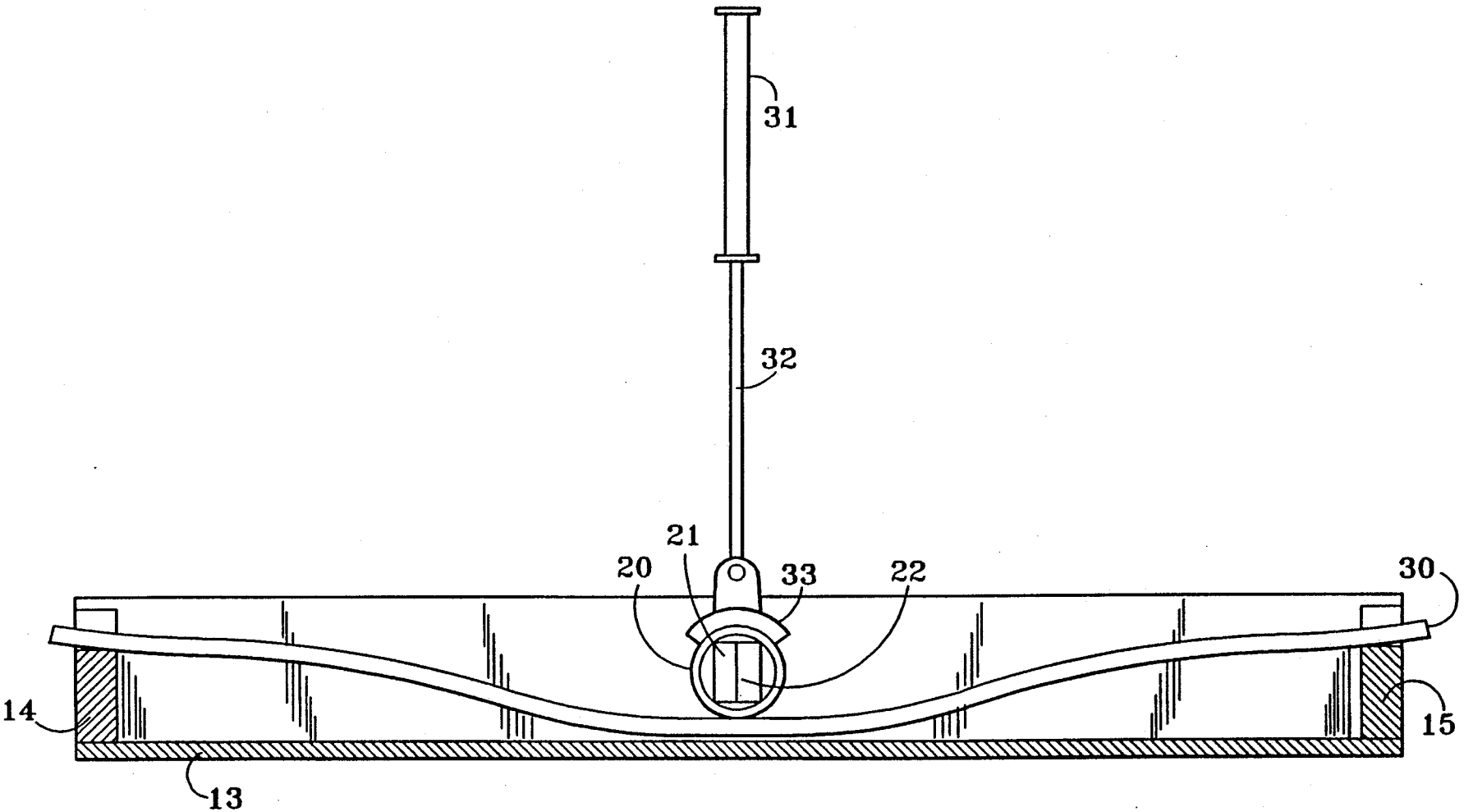
FIG. 2 is a longitudinal cross sectional view of the fixture of FIG. 1 with a wooden pole shown being forced downwardly to the bent configuration.

Referring now more particularly to FIG. 1, there is shown the alternate embodiment of a holding fixture 10 to receive a wooden pole for the bending thereof. Fixture 10 includes a channel shaped main body consisting of a pair of upright walls 11 and 12 integrally joined to a bottom wall 13 with a pair of blocks 14 and 15 fixedly mounted at the opposite ends of the main body. Blocks 14 and 15 include respectively recesses 16 and 17 to receive the opposite ends of the wooden pole to be positioned in the fixture such as shown in FIG. 2.

An intermediate holding cylindrical tube 20 has a length slightly less than the distance between the spaced-apart upright walls 11 and 12 and may be positioned downwardly along dashed lines 25 and 26 against pole 30 to be aligned with the holes 18 and 19 extending through respectively upright walls 11 and 12. The width of hole 18 and hole 19 is less than the outside diameter of intermediate holding member 20 to prevent member 20 from passing through either hole. A pair of wedge shaped elements 21 and 22 are alignable respectively with holes 18 and 19 and may be moved along respectively dashed lines 27 and 28 to extend through the holes and into the opposite ends 23 and 24 of member 20. Elements 21 and 22 thus project through walls 11 and 12 into the member 20 locking the member to the walls. Each element 21 and 22 has a width approximately one half the width of hole 18 and one half the width of hole 19 enabling element 21 and 22 to be in a side by side relationship when inserted in member 20 as shown in FIG. 2.

A pneumatic or hydraulic conventional cylinder 31 includes an extendable piston rod 32 having an arcuate shaped member 33 fixedly mounted to the distal end thereof. Member 33 includes a downwardly facing surface complementary in shape to the outwardly cylindrical surface of member 20 to rest thereagainst when the piston rod is extended.

The method of permanently bending a green wooden pole to a final configuration includes the first step of harvesting a tree during the warm growing season and then positioning the green wooden tree or pole in the holding fixture so that the opposite ends of the pole rest within recesses 16 and 17. Thus, the opposite ends of the wooden pole are located at pre-determined fixed elevations each of which is located outwardly of the upwardly facing surface of bottom wall 13. The intermediate member 20 is then moved downwardly along lines 25 and 26 to be positioned atop and against the center portion of pole 30. The piston rod 32 is extended to force arcuate shaped member 33 against member 20 thereby applying external force against the intermediate member which transmits the external force directly to pole 30. Member 20 is moved sufficiently downward to align the hollow ends 23 and 24 relative to holes 18 and 19 and allowing wedges 21 and 22 to be extended through walls 11 and 12 and partially into member 20 thereby holding the intermediate member relative to walls 11 and 12 and against the pole. The external force is removed by retracting piston rod 32 while wedges 21 and 22 hold the pole in the bent configuration even upon removal of the external force. Thus, intermediate member 20 is locked to holding fixture 10 limiting relative motion therebetween.

The method further includes the step of heating the wooden pole after the pole is in the bent configuration of FIG. 2 by inserting the fixture 10 and pole 30 into a dry kiln for at least 48 hours and preferably for approximately three days at an approximate temperature of 160° F. During this heating step, any insect eggs located within the pole will be destroyed and the pole will be permanently set in the bent configuration. By utilizing a green tree or pole and inserting it into the fixture, the pole does not first have to be subjected to water since the pole will readily bend while in a green state. I have discovered that best results are obtained by placing the green pole within the fixture and then bending and heating the pole within ten days of harvesting thereby minimizing the time for hatching of any eggs located within the tree. During the heating step, all living things foreign to the pole but located in the pole will be destroyed. Once the heating step is concluded, the fixture and pole is removed from the kiln. Wedges 21 and 22 are then removed along with intermediate member 20 and the pole may be removed from the fixture in the permanent bent configuration.

Many variations are contemplated and included in the present invention. For example, the fixture may be utilized to permanently bend a wooden pole even though the pole is not in the green condition. In such a case, the wooden pole is positioned in the holding fixture and the center of the pole is forced against the bottom wall of the fixture to cause the pole to assume a bent configuration such as shown in FIG. 2. The wooden pole if dry may be wetted with hot water. Similarly, the pole while bent may be inserted into the kiln to kill living things foreign to the pole.

Figure 3:
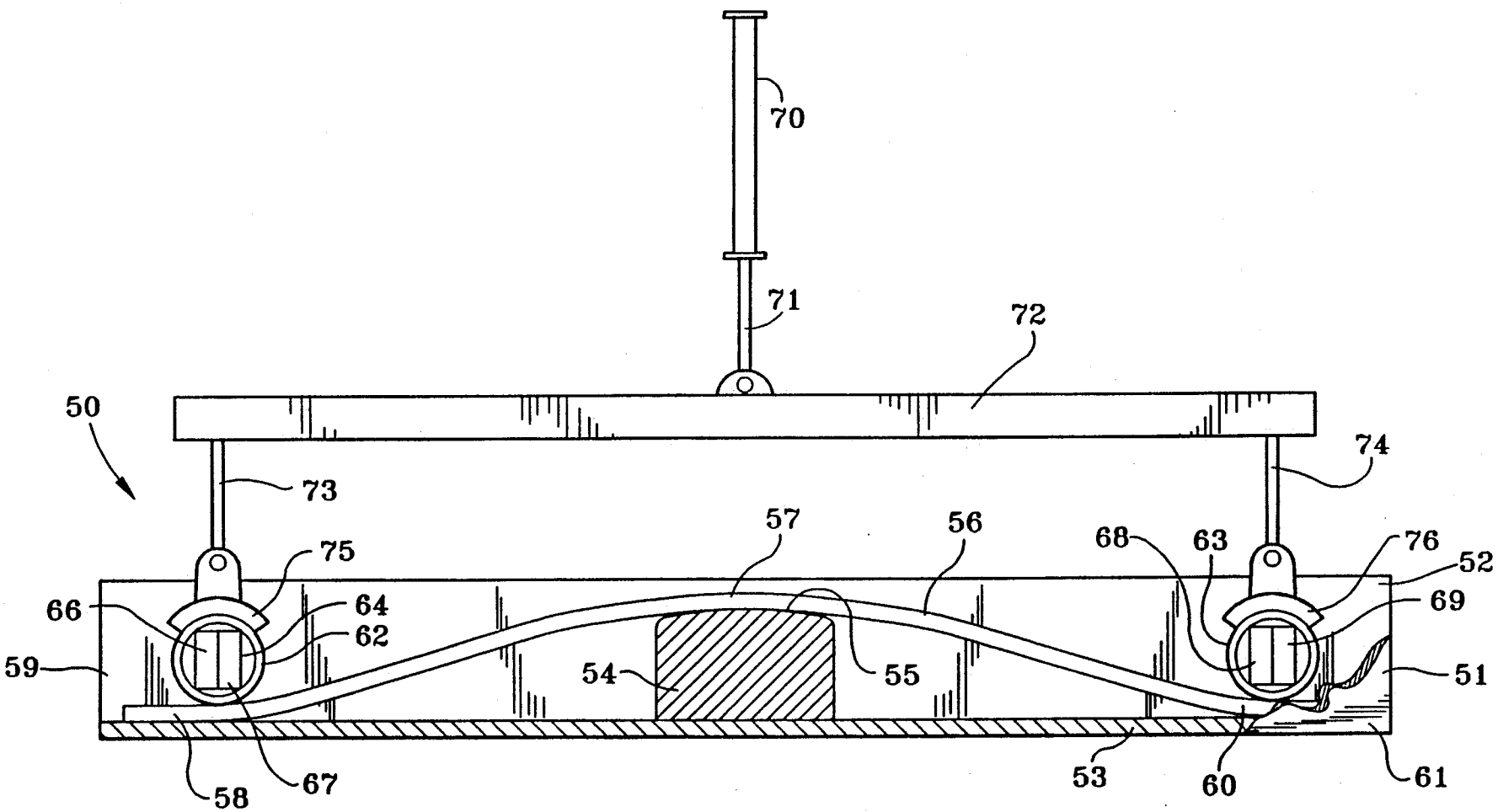
FIG. 3 is a longitudinal cross sectional view of the preferred embodiment of the holding fixture with a wooden pole shown being forced downwardly to the bent configuration.

The preferred embodiment of the holding fixture is shown in FIG. 3. Fixture 50 includes a pair of side walls 51 and 52 fixedly mounted to and extending upwardly from the longitudinally extending side edges of bottom wall 53. A center block 54 is mounted atop bottom wall 53 and extends between and is fastened to the side walls 51 and 52. The top surface 55 of block 54 is concave to receive the center portion 57 of a wooden pole 56 to be rested thereatop. Fixture 50 is shown fragmented with only a portion of side wall 51 being depicted to more clearly illustrate the interior of the fixture. The opposite ends 59 and 61 of fixture 50 are open to allow the opposite ends 58 and 60 of pole 56 to extend therethrough.

An external force generating means is positioned to force the opposite ends 58 and 60 of pole 56 downwardly toward bottom wall 53 while the center portion 57 of the pole is held stationary atop surface 55. The external force generating means includes a hydraulic or pneumatic conventional cylinder 70 having an extendable piston rod 71 joined to the cross bar 72. A pair of legs 73 and 74 depend from cross bar 72 with a pair of concave members 75 and 76 pivotally mounted to the bottom ends of the legs. A pair of hollow cylinders 62 and 63 each have a length less than the distance between the side walls 51 and 52, thereby allowing the hollow cylinders to be positioned downwardly respectively against ends 58 and 60 of pole 56. The external surfaces of cylinders 62 and 63 are complementary received against the downwardly facing convex surfaces of members 75 and 76. Thus, cylinder 70 may be operated to extend rod 71, thereby forcing members 75 and 76 downwardly against the hollow cylinders 62 and 63 and forcing the opposite ends 58 and 60 of pole 56 downwardly toward bottom wall 53 creating the desired bent configuration in the pole. As was the case with the embodiment shown in FIGS. 1 and 2, side walls 51 and 52 include aligned apertures through which wedges 66–69 may be projected to secure cylinders 62 and 63 in the downward position with piston rod and members 75 and 76, then being withdrawn upwardly apart from the fixture. That is, side walls 51 and 52 each include a pair of aligned apertures similar to apertures 18 and 19 for receiving wedge shaped members 68 and 69 through the apertures and into cylinder 63 with a portion of the wedge shaped members 68 and 69 remaining external of side walls 51 and 52, thereby locking cylinder 63 in place. Similarly, side wall 51 and 52 includes a pair of apertures aligned with the hollow interior of cylinder 62 to receive wedge shaped projections 66 and 67 which extend through the side walls and into cylinder 62 with a portion of wedge shaped projections remaining external to the side walls, thereby locking cylinder 62 in place. One such aperture 64 is depicted in FIG. 3.

The method of permanently bending a green wooden pole to a final configuration utilizing the fixture shown in FIG. 3 includes the step of first harvesting the tree in the warm growing season and then removing the limbs from the tree in order to create a wooden pole. Next, the pole is heated in a conventional kiln at a temperature of approximately 160° for 48 hours to destroy the living things such as powder post beetles which are foreign to the pole but are located within the pole. The heating step is accomplished as soon as possible after the harvesting step. For example, the poles should be heated within several days, that is two to four days, after the harvesting step, and thus are heated during the warm growing season. The poles may then be stored until the pole is to be used, that is, incorporated into a piece of furniture or other article. Once it is determined the pole is needed, then either the pole can be utilized in the unbent configuration or may be bent to a desired configuration. In the latter case, the pole is positioned in a holding fixture shown in FIG. 3 with the opposite ends of the pole then being bent to the downward position, thereby creating the bent configuration in the pole. Wedges 66–69 are inserted into hollow cylinders 62 and 63 and the external force generating means is then removed from the fixture. In other words, the downwardly facing surfaces of members 75 and 76 are moved apart from the upwardly facing convex exterior surface of cylinders 62 and 63. The fixture with pole is then heated in order to permanently set the bent configuration in the pole. Notably, the heating step to bend the pole may be accomplished either immediately after the harvesting and first heating step to kill the eggs and beetles or may be delayed until a later time with the first heating step occurring immediately after harvesting to destroy the eggs and beetles, whereas the second heating step may occur at anytime, such as winter to permanently set the bent configuration in the pole. The second heating step has a length of approximately 48 hours after which the pole is removed from the holding fixture.

This latter method can be utilized with either the fixture shown in FIG. 1 and 2 or the fixture shown in FIG. 3. In the first case, the intermediate member is located against the center of the pole with the external force generated by the cylinder applying force to the cylinder thereby forcing the center portion downward with the cylinder then being secured against the pole by the wedges upon removal of the external force. On the other hand, in the event the fixture of FIG. 3 is utilized, then the cylinders are located against the opposite ends of the pole and external force is applied against the cylinders transmitting the external force to the ends of the pole. The cylinders are then locked in place in the lower position by the wedges and the external force from cylinder 70 is then removed.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of permanently bending a green wooden pole to a final configuration comprising the steps of:

positioning a green wooden pole in a holding fixture;

locating the center of said pole at a predetermined elevation;

forcing the opposite ends of said pole to an elevation past said predetermined elevation to bend said pole to the desired bent configuration;

heating said pole while bent to simultaneously kill living things foreign to but located in said pole while permanently setting said bent configuration in said pole; and, removing said pole from said holding fixture.

2. The method of claim 1 and comprising the further step of:

harvesting said pole during the warm growing season within ten days prior to said positioning and heating steps.

3. The method of claim 1 wherein said forcing step includes the sub-steps of:

locating a pair of intermediate members against said pole at said ends;

applying external force against said intermediate members transmitting said external force to said pole;

removing said external force from said intermediate members; and, holding said intermediate members against said pole to maintain said pole in said bent configuration upon removal of said external force.

4. The method of claim 3 wherein:

said holding sub-step includes locking said intermediate members and said holding fixture together.

5. The method of claim 4 wherein:

said holding sub-step includes extending elements through said holding fixture and said intermediate members limiting relative motion therebetween.

6. A method of preparing wooden poles for subsequent use comprising the steps of:

harvesting a tree in the warm growing season;

removing limbs from said tree to create a wooden pole;

heating said pole in a kiln subsequent to said harvesting step but during said warm growing season to destroy living things foreign to but located in said pole; and, storing said pole until said pole is to be used.

7. The method of claim 6 wherein:

said heating step occurs within several days of said harvesting step; and, said pole is stored until winter when it is used.

8. The method of claim 6 and comprising the further steps of:

positioning said pole in a holding fixture;

bending said pole to the desired bent configuration while in said holding fixture;

applying heat to said pole while bent, at any time including during winter, to permanently set said bent configuration in said pole; and, removing said pole from said holding fixture.

9. The method of claim 7 comprising the step of:

maintaining said pole in a heated state during said heating step for 48 hours.

10. The method of claim 8 wherein:

said bending step includes the sub-steps of:

locating intermediate members against the ends of said pole;

applying external force against said intermediate members transmitting said external force to said pole;

removing said external force from said intermediate members; and, holding said intermediate members against said pole to maintain said pole in a bent configuration upon removal of said external force.

11. The method of claim 8 wherein:

said bending step includes the sub-steps of:

locating an intermediate member against the center of said pole;

applying external force against said intermediate member transmitting said external force to said pole;

removing said external force from said intermediate member; and, holding said intermediate member against said pole to maintain said pole in a bent configuration upon removal of said external force.

12. A fixture for placing a permanent bend into a wooden pole creating a bent configuration comprising:

frame means with opposite portions to receive the opposite ends of a wooden pole with said frame means also including a middle portion located between said opposite portions whereby the center portion of the wooden pole may be located;

intermediate members positionable against said ends of said pole;

force generating means with an output restable against said intermediate members operable to force said intermediate members against said pole at said opposite portions of said frame means creating a bend in said pole; and, holding means engaged with said frame means and said intermediate members operable to hold said intermediate members against said pole in the bent configuration even though said force generating means is removed.

13. The fixture of claim of claim 12 wherein:

said intermediate members include first surface means and said force generating means includes second surface means mutually opposed to said first surface means, said force generating means when against said intermediate members is unattached relative thereto but has said second surface means forced against said first surface means.

14. The fixture of claim 13 wherein:

said frame means includes a side wall with pairs of holes extending therethrough;

said holding means includes elongated elements extendable through said holes into said intermediate members to limit relative motion between said intermediate members and said frame means.

15. The fixture of claim 14 wherein:

said holding means includes wedges extendable into opposite ends of said intermediate members which include hollow cylinders.

* * * * *